US006443134B1

(12) United States Patent
Von Werder et al.

(10) Patent No.: US 6,443,134 B1
(45) Date of Patent: Sep. 3, 2002

(54) INTAKE DEVICE FOR AN INTERNAL COMBUSTION ENGINE

(75) Inventors: Martin Von Werder, Schwalbach; Reinhard Fischer, Niederdorfelden, both of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/622,868

(22) PCT Filed: Feb. 18, 1999

(86) PCT No.: PCT/EP99/01060

§ 371 (c)(1),
(2), (4) Date: Nov. 14, 2000

(87) PCT Pub. No.: WO99/43946

PCT Pub. Date: Sep. 2, 1999

(30) Foreign Application Priority Data

Feb. 24, 1998 (DE) ..... 198 07 463

(51) Int. Cl.[7] ..... F02M 25/07
(52) U.S. Cl. ..... 123/568.17; 123/519; 123/585
(58) Field of Search ..... 123/568.17, 572, 123/574, 519, 699, 698, 585; 285/132.1, 133.3, 133.6, 133.11

(56) References Cited

U.S. PATENT DOCUMENTS 4,741,295 A * 5/1988 Hosoya et al. ..... 123/568.17
4,938,176 A * 7/1990 Tamaka et al. ..... 123/568.17
5,207,714 A * 5/1993 Hayashi et al. ..... 123/568.17
5,492,104 A * 2/1996 Elder et al. ..... 123/568.17
5,603,295 A 2/1997 Toepfer et al.
5,970,960 A * 10/1999 Azuma ..... 123/568.12

FOREIGN PATENT DOCUMENTS

| | | |
|---|---|---|
| DE | 3932300 | 4/1991 |
| DE | 69101622 | 4/1994 |
| DE | 4338194 | 5/1995 |
| DE | 19627035 | 1/1998 |
| DE | 19740998 | 3/1998 |
| DE | 19649713 | 6/1998 |
| EP | 0507996 | 10/1992 |
| EP | 0647779 | 4/1995 |
| EP | 0791743 | 8/1997 |
| EP | 0816666 | 1/1998 |
| JP | 63-164554 A1 * | 4/1987 |

* cited by examiner

*Primary Examiner*—Andrew M. Dolinar
*Assistant Examiner*—Arnold Castro
(74) *Attorney, Agent, or Firm*—Martin A. Farber

(57) ABSTRACT

An invention relates to an intake device for an internal combustion engine, to which at least combustion air and an additional fluid can be supplied via an air inlet line (1). The air inlet line (1) has an opening, in particular a hole (9), through which a guide tube (11) projects into the air inlet line (1).

6 Claims, 5 Drawing Sheets

INTAKE DEVICE FOR AN INTERNAL COMBUSTION ENGINE

FIELD AND BACKGROUND OF THE INVENTION

The invention relates to an intake device for an internal combustion engine, to which at least combustion air and an additional fluid can be supplied via an air inlet line.

EP 0 507 996 A2 has disclosed a device for the metered feeding of burnt gases into the combustion space of an internal combustion engine. A line branches off from an exhaust pipe of the internal combustion engine, the recirculated exhaust gas being supplied under the control of a valve to an intake pipe and then being involved in the process of combustion in the internal combustion engine. This prior art does not provide any details on the connection of the feed line to the intake pipe.

SUMMARY OF THE INVENTION

The object on which the invention is based is to provide an intake device for an internal combustion engine which is distinguished by simplicity of design and very good efficiency.

The presence of an opening through which a guide tube projects into the air inlet line in accordance with the invention has the advantage that it is possible to use as a guide tube a simple and therefore economical piece of tube which is inserted through the opening into the air inlet line and fixed in a loss-proof manner. The introduction of an opening as a hole is a simple production process, it being necessary to allow for this hole during the production of the air inlet line rather than having to make it subsequently. The fact that the guide tube projects into the air inlet lines provides the advantage that high wall temperatures of the air inlet line are avoided, and the additional fluid supplied is fed into the main flow passing through the air inlet line. It also avoids excessive temperatures in the region where the additional fluid is fed in (if this region is manufactured from metal) from leading to impermissible heating or even destruction of flanged-on lines, especially when these are manufactured from plastic. Large differences in temperature, which lead to fatigue of the materials, are thus also avoided. The additional fluid which can be fed in is, for example, recirculated exhaust gas, but it could also be fresh air, a fuel/air mixture or turbulent fuel.

As a development of the invention, the air inlet line has a throttle body with a throttle valve, the hole with the guide tube being arranged in the region of the throttle body. This throttle body, which, in a manner known per se, has a drivable throttle valve for varying the power output of the internal combustion engine, thus forms a modular unit in which the hole for receiving the guide tube is provided. This has the advantage that the throttle body can be preassembled as a unit, on which it is then only necessary to produce the air feed, e.g. from an air filter, and the connection to the intake region of the internal combustion engine.

As a development of the invention, the air inlet line or the throttle body has a flange for the attachment of a valve for the supply of the additional fluid, the hole with the guide tube being arranged in the region of the flange. This has the advantage that the valve (e.g. an exhaust-gas recirculation valve) can be fixed directly on the air inlet line or the throttle body, thus ensuring a compact construction. The valve can, of course, also be arranged at another location, in which case the flange is used for the attachment of a feed line for the additional fluid.

As a development of the invention, the air inlet line or the flange can be connected firmly to the guide tube. This ensures that the guide tube is fixed in a loss-proof manner since, if it falls into the air inlet line, it can lead to damage, possibly even destructive damage, to the internal combustion engine. The firm connection can advantageously be achieved by means of a pressing operation since, particularly when taking into account the high temperatures which occur in exhaust-gas recirculation, it can be implemented in a simple manner. Other fixing processes, such as welding, adhesive bonding or the like, are also conceivable, and not only force-locking connections but also form-locking connections which, in particular, meet the temperature requirements, should be taken into account.

As a development of the invention, an at least partially encircling groove, into which one end region of the guide tube can be pressed, is provided in the air inlet line or in the flange, in the region of the hole. This ensures not only security against loss but also a sealing effect and good feeding in of the additional fluid in a manner which is favorable in terms of flow. Another advantage is that involved machining of the guide tube is not necessary, making it possible to use a commercially available piece of tube. It is likewise advantageous that involved machining (e.g. finishing turning) of the sealing surface of the flange is eliminated.

As a development of the invention, the guide tube can be inserted into the hole and has means, in particular a encircling collar, by means of which the guide tube can be held in a nominal position. This has the advantage that no further machining steps are required in the region of the hole to install the guide tube. It is simply inserted into the hole until the collar comes to rest against the sealing surface of the flange (or the surface of the air guide tube), thus giving not only simplicity of installation but, once again, a high degree of security against loss. The use of an installation tool is not necessary since the guide tube is fixed in its nominal position once the valve or another feed line has been attached to the flange.

As a development of the invention, in one end region, by which it projects into the air inlet line, the guide tube has a flattened portion. This has the advantage that the guide tube can be inserted more quickly and in a more simple manner into the hole since constrained guidance is provided owing to the flattened portion. A flattened portion of this kind is advantageous particularly when the diameters of the hole and of the guide tube are very largely the same. On the other hand, a flattened portion of this kind can be omitted or used nevertheless if the diameter of the air guide tube is significantly less than the diameter of the hole, in which case it should be ensured that the means by which the guide tube can be held in its nominal position are of appropriate design (particularly that their diameters are chosen to be greater than the diameter of the hole) in order to ensure the security against loss.

As a development of the invention, in its other end region, which points in the direction of the valve, the guide tube has a triangular shape. By virtue of this triangular shape in one end region of the guide tube, an additional prestress is produced in the holding region, in particular in the region of the encircling groove, to ensure that the guide tube fits tightly.

As a development of the invention, the guide tube is arranged on the valve or is part of the valve. In this alternative configuration, it is possible to combine security against loss with accurately targeted feeding of the additional fluid into the air inlet line in order to avoid impermissibly high wall temperatures of the air inlet line in the region of introduction. Moreover, simplicity of installation is increased since, in this configuration, the guide tube and the valve form a modular unit and thus only the valve, in particular its housing, has to be fixed on the air inlet line.

As a development of the invention, the additional fluid is the exhaust gas from an internal combustion engine, the valve being provided as an exhaust-gas recirculation valve in particular as a controllable valve. Exhaust-gas recirculation valves are known per se and used to increase the efficiency of the internal combustion engine, and it is therefore not necessary to refer further here to their advantages. The use of the guide tube is particularly advantageous when the exhaust gas from the internal combustion engine is recirculated as the additional fluid since, in this case, high temperatures are present, which can lead to impermissibly high wall temperatures and to fatigue of the materials due to high temperature fluctuations in the region of introduction and at the flange (throttle body of metal, flanged-on lines made of plastic), these temperatures being avoided in an effective manner by the use of the guide tube, which directs the exhaust gases into the central area of the air inlet line.

Owing to the configuration of the air inlet line, it seems appropriate to provide the air inlet line subsequently with an opening, in particular the hole already mentioned, and to introduce the guide tube into this. Also conceivable are production methods in which at least one guide tube ("stub"), which projects into the air inlet line, is provided. The same applies, for example, to aluminum diecasting methods for the production of throttle bodies. As a supplementary measure to this, the flange for the valve can also be provided at as early a stage as the production of the air inlet line, especially when the latter is cast.

In addition to feeding in exhaust gas as the additional fluid, as described, it is, of course, also possible to feed in other gases (e.g. fresh air or a fuel/air mixture) or to feed in fuel in a controlled manner. The preferred areas of application are spark-ignition and diesel internal combustion engines.

BRIEF DESCRIPTION OF THE DRAWINGS

An exemplary embodiment of an intake device and a number of configurations of a guide tube are described below and explained with reference to the figures of the drawings, of which.

DETAILED DESCRIPTION OF THE PREFERRED EMBODIMENT

Figure 1:
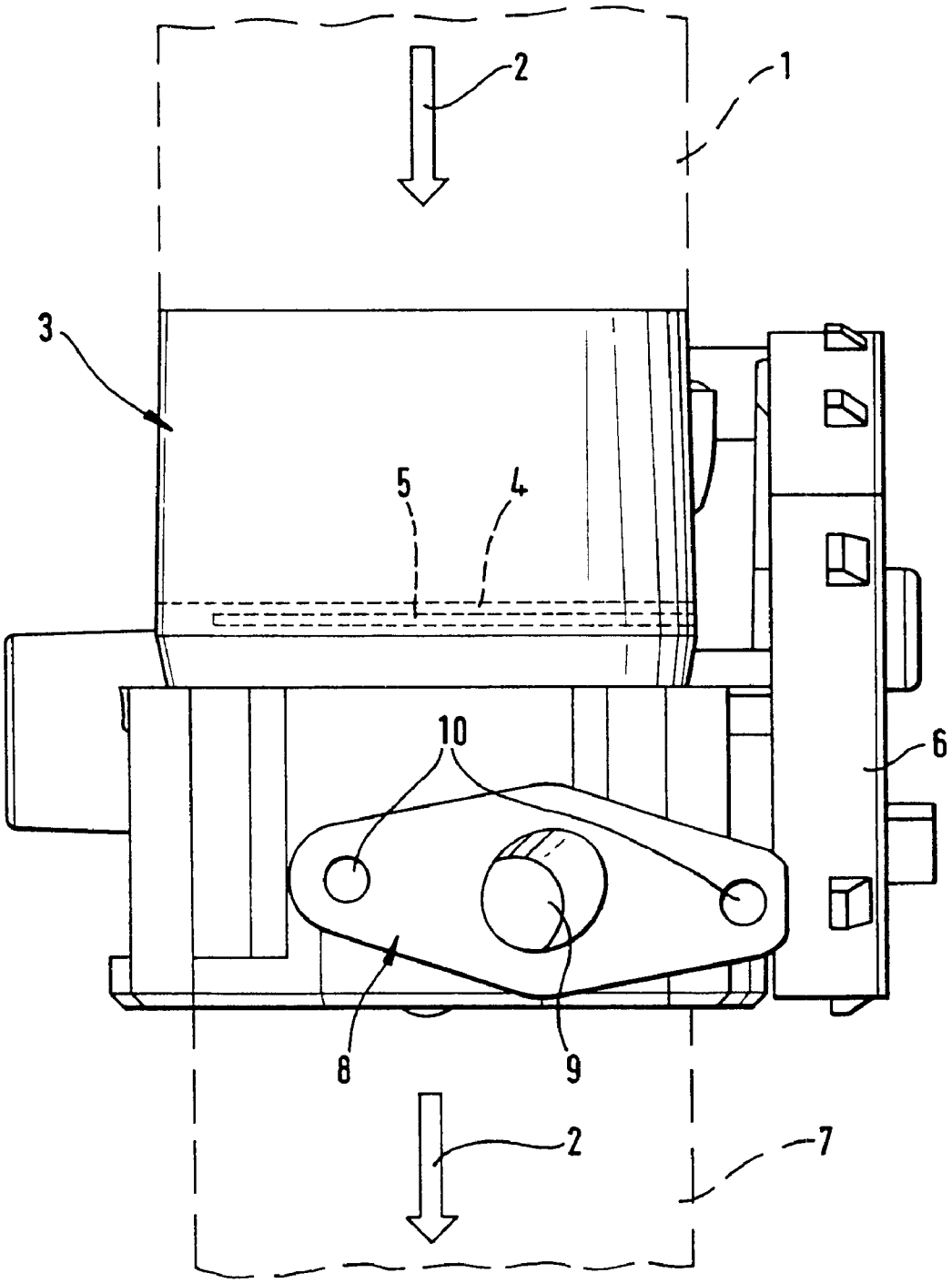
FIG. 1 shows a throttle body.

FIG. 1 shows a piece of an air inlet line 1, through which combustion air for an internal combustion engine is fed from an air filter (not shown), for example, in direction of flow 2 to a throttle body 3. This throttle body 3 forms a modular unit and is connected firmly to the air inlet line, although it would also be conceivable for the air inlet line 1 to be fixed to the throttle body 3. For the purpose of adjusting the power output of the internal combustion engine, the throttle body 3 has a throttle valve 4, which is arranged on a throttle-valve shaft 5, the throttle-valve shaft 5 being movable between a closed position and an open position by a drive arranged in a housing 6. The way in which a throttle body of this kind operates is known per se and it is therefore not necessary to go into this further. Adjoining the throttle body 3 on the outlet side in the direction of flow 2 is an intake pipe 7, which leads, likewise in a manner known per se, to the internal combustion engine, in particular the intake duct of the individual cylinders. The throttle body 3 (or the air inlet line 1 or the intake pipe 7) has a flange 8, there being a hole 9 in the region of this flange 8. The flange 8 and the hole 9 can be provided during the production of the throttle body 3 or, as an alternative, can be produced by subsequent machining. The flange 8 furthermore has fixing holes 10, further details of which will be given later.

Referring to FIG. 1, the various configurations of and fixing options for a guide tube according to the invention will be described below.

Figure 2:
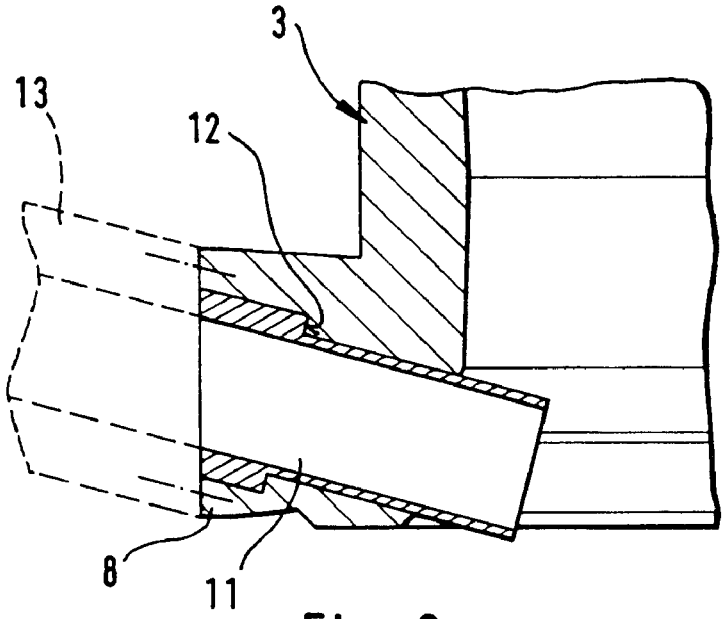
FIGS.2 to 10 show configurations and installation locations of various guide tubes.

FIG. 2 shows that a guide tube 11 is supported on an offset 12. The reference numeral 13 denotes an at least partially illustrated valve (in particular an exhaust-gas recirculation valve), which is fixed to the flange 8 with a seal in between, this being effected by means of screws, which are screwed into the fixing holes 10. This method of fixing has the advantage that there is no need for any further machining operations within the hole. Particularly if the hole 9 is cast integrally during the production of the throttle body 3, it is conceivable to make it conical in the direction of the interior of the throttle body 3 in order to ensure security against loss.

Figure 3:
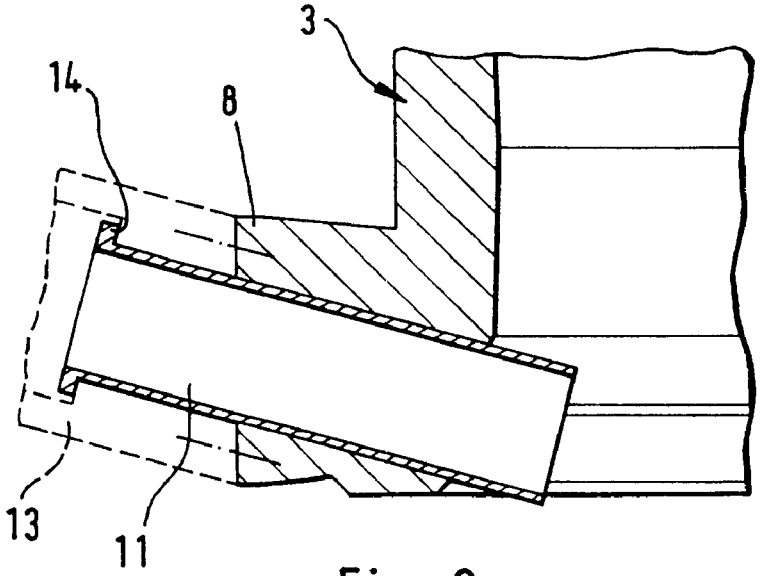

FIG. 3 shows that the guide tube 11 has a collar 14 in its end region pointing in the direction of the valve 13. By means of this collar 14, the guide tube 11 can be held in a loss-proof manner either against the sealing surface of the flange 8 or else against a correspondingly shaped offset within the valve 13. This has the advantage that, apart from the formation of the hole 9 in the air inlet line 1 or the throttle body 3, no further machining of these components is required and assembly is simple.

Another advantage is that if the guide tube 11 has already been inserted into the valve 13, these two elements can be installed quickly and in a simple manner.

Figure 4:
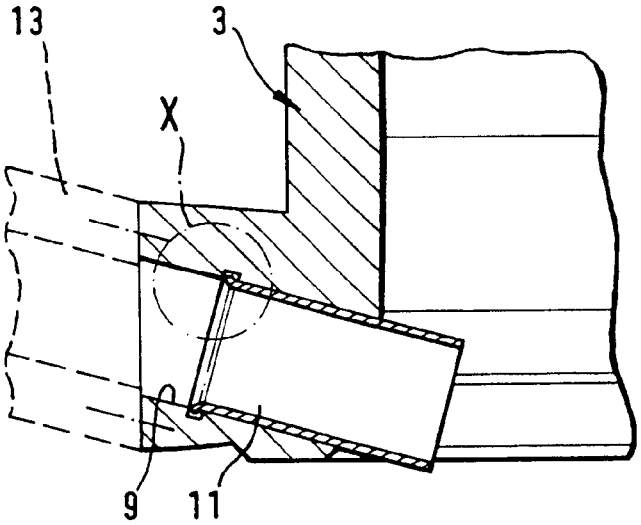
Figure 5:
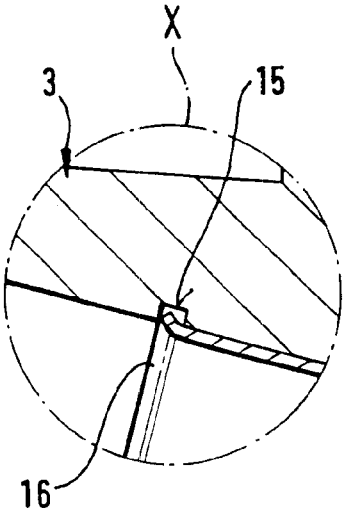
Figure 6:
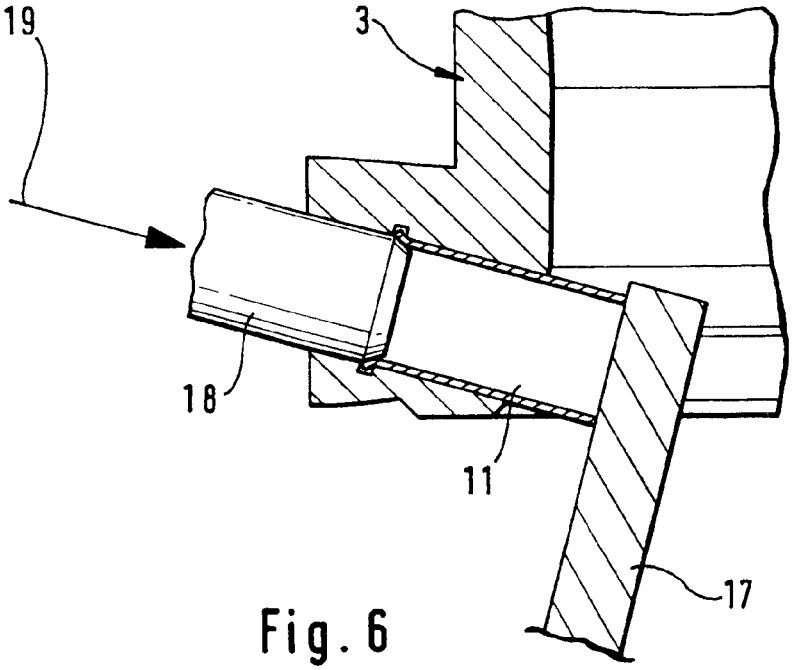

FIGS. 4 to 6 show that the guide tube 11 is connected firmly to the throttle body 3 (alternatively to the air inlet line 1), FIG. 6 also showing the pressing operation.

FIG. 4 shows that the guide tube 11 is inserted into the hole 9 again in the throttle body 3. In this configuration, it is particularly advantageous if the guide tube 11 is a commercially available piece of tube with a length such that, on the one hand, the tube does not project beyond the sealing surface of the flange 8 and, on the other hand, one piece projects into the air inlet line 1 or throttle body 3 for controlled supply of the fluid. In this context, the inside diameter of the guide tube 11 should be chosen so that the required volume of additional fluid can be supplied.

FIG. 5 shows the inserted guide tube 11 after the completion of the pressing operation, the reference numeral 15 denoting an encircling groove in the throttle body 3, into which the widened end 16 of the guide tube 11 engages after the completion of the pressing operation. This firstly ensures security against loss; at the same time, the pressing operation can be performed in such a way that the widened tube end 16 connects the guide tube 11 to the throttle body 3 in a sealing manner, although this is not absolutely essential since the sealing action for the fluid supplied is ensured by fixing the valve 13 to the flange 8, in particular with a seal in between.

FIG. 6 shows the actual pressing operation, for which purpose a counterholder 17 is introduced into the interior of the throttle body 3 (or the air inlet line 1) into an installation position for the guide tube 11. The guide tube 11 is then introduced into the hole 9 from outside until one end comes to rest against the counterholder 17. The position of the counterholder 17 and the length of the guide tube 11 are matched to one another in such a way that that end of the guide tube 11 which faces away from the counterholder 17 ends at the level of the encircling groove 15. After this, a pressing tool 18 (e.g. a punch which has a conical flattened portion at the end, as shown in FIG. 6) is moved in the pressing direction 19, with the result that the tube end is widened in the region of the encircling groove 15 and, depending on the pressing pressure or configuration of the end of the pressing tool 18, comes to rest in a sealing manner in the encircling groove 15. A large sealing surface can thus be achieved with a simple and economical guide tube 11, and the required security against loss is provided. Moreover, the use of the counterholder 17 and of the pressing tool 18 and the entire pressing operation can be automated for series production.

Figure 7:
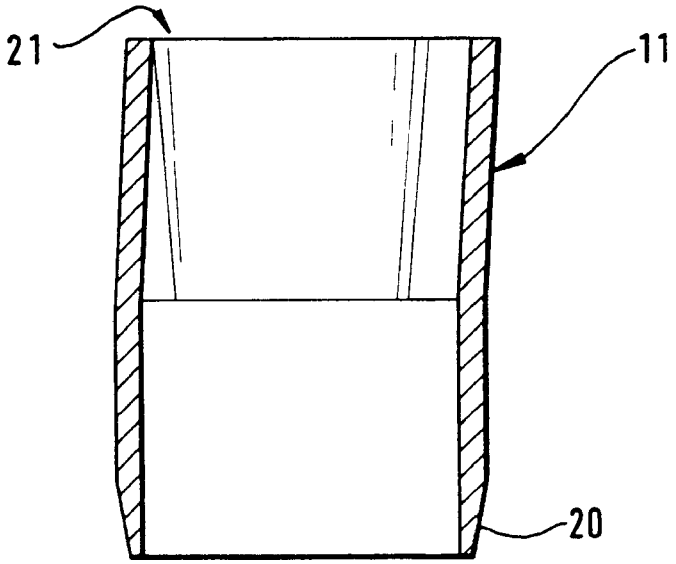
Figure 8:
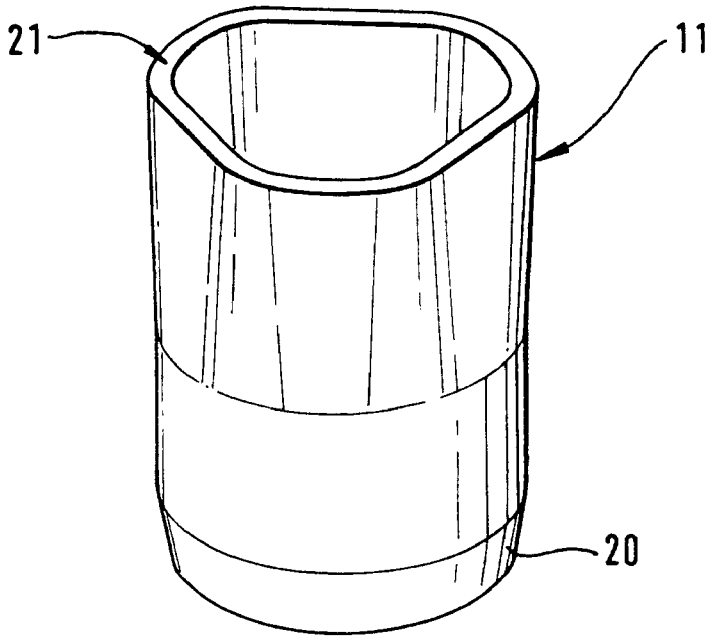

FIGS. 7 and 8 again show a guide tube 11 which, in one end region, by which it projects into the air inlet line 1, has a flattened portion 20. This flattened portion 20 can be produced by turning, for example, and can also be employed in the case of the guide tubes shown in the preceding figures in order to simplify installation. In its other end region, which points in the direction of the valve 13, the guide tube 11 has a triangular shape 21 in order to produce an additional prestress in the region of the encircling groove 15 and in order to ensure that the guide tube 11 fits tightly on completion of the pressing operation.

Figure 9:
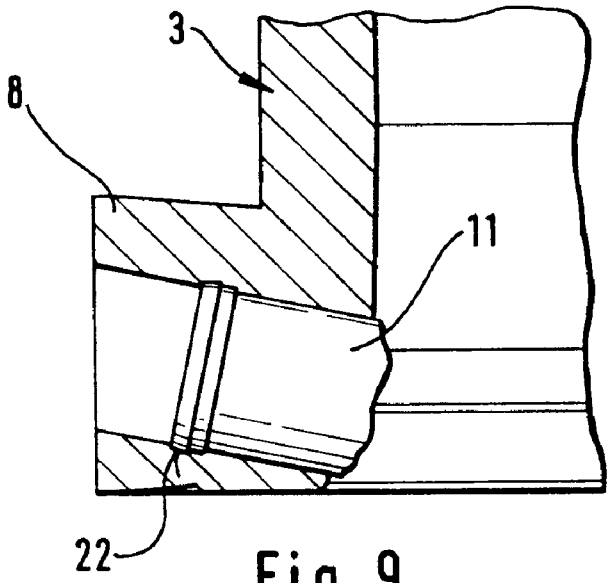

FIG. 9 shows a guide tube 11 which is fixed in the throttle body 3 in an encircling groove 22 which is step-shaped or very largely round.

Figure 10:
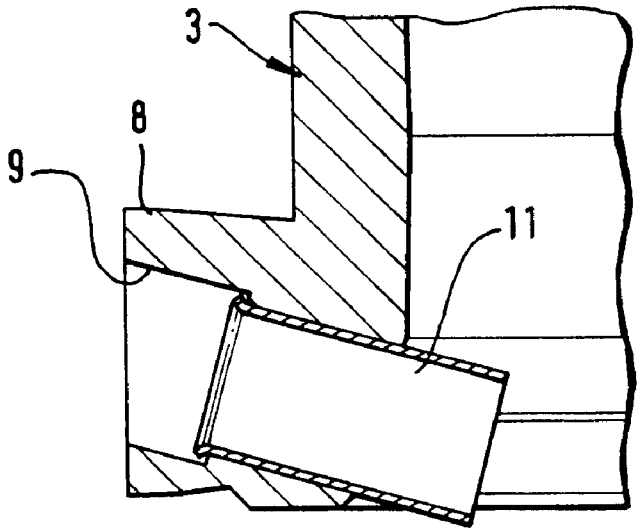

FIG. 10 shows a throttle body 3 which has a stepped hole 9, the inward-facing diameter of the hole corresponding very largely to the diameter of the guide tube 11 and accommodating the latter. The outward-facing part has a diameter which is greater than the outside diameter of the guide tube 11, giving rise to an offset by means of which the guide tube 11, which has been widened at this end before or after insertion, is held in a form- and/or force-locking and loss-proof manner.

List of Reference Numerals

1. Air inlet line
2. Direction of flow
3. Throttle body
4. Throttle valve
5. Throttle-valve shaft
6. Housing (behind it: drive)
7. Intake pipe
8. Flange
9. Hole
10. Fixing holes
11. Guide tube
12. Offset
13. Valve
14. Collar
15. Encircling groove
16. Widened tube end
17. Counterholder
18. Pressing tool
19. Pressing direction
20. Flattened portion
21. Triangular shape
22. Groove

We claim:

1. An intake device for an internal combustion engine, to which at least combustion air and an additional fluid can be supplied via an air inlet line (1), the device comprising a guide tube, and wherein the air inlet line (1) has an opening, in particular a hole (9), through which opening said guide tube (11) projects into the air inlet line (1), wherein an at least partially encircling groove (15), into which one end region of the guide tube (11) is pressable, is provided in the air inlet line (1), in the region of the hole (9) and in another end region of said guide tube, which points in direction of a valve (13) for supply of the additional fluid, the guide tube (11) has a triangular shape (21).

2. The intake device as claimed in claim 1, wherein the air inlet line (1) has a throttle body (3) with a throttle valve (4), the hole (9) with said guide tube (11) being arranged in a region of the throttle body (3).

3. The intake device as claimed in claim 1, wherein the air inlet line (1) has a flange (8) for attachment of a valve (13) for supply of the additional fluid, the hole (9) with the guide tube (11) being arranged in a region of the flange (8).

4. The intake device as claimed in claim 1, wherein the air inlet line (1) is firmly connectable to the guide tube (11).

5. The intake device as claimed in claim 1, wherein, in one end region, by which said guide tube projects into the air inlet line (1), the guide tube (11) has a flattened portion (20).

6. The intake device as claimed in claim 1, wherein the additional fluid is exhaust gas from an internal combustion engine, and a valve (13) for supply of the additional fluid is an exhaust-gas recirculation valve.

* * * * *